United States Patent [19]

Brown

[11] Patent Number: 5,025,545

[45] Date of Patent: Jun. 25, 1991

[54] METHOD OF ATTACHING AND ADJUSTING A CABINET DRAWER GUIDE ASSEMBLY

[75] Inventor: James L. Brown, Sellersburg, Ind.

[73] Assignee: Haas Cabinet Co., Inc., Sellersburg, Ind.

[21] Appl. No.: 569,771

[22] Filed: Aug. 21, 1990

Related U.S. Application Data

[60] Continuation of Ser. No. 341,700, Apr. 17, 1990, abandoned, which is a division of Ser. No. 222,508, Jul. 21, 1988, abandoned.

[51] Int. Cl.[5] ..... B23P 11/00

[52] U.S. Cl. ..... 29/434; 29/453

[58] Field of Search ..... 16/94 R; 29/434, 453, 29/525.1; 248/220.2, 221.4, 225.1, 251; 312/338; 384/22

[56] References Cited

U.S. PATENT DOCUMENTS

| | | | |
|---|---|---|---|
| 3,090,662 | 5/1963 | Dargene | 312/343 |
| 3,149,811 | 9/1964 | Frenstad et al. | 248/251 |
| 3,675,883 | 7/1972 | Holmes et al. | 248/251 |
| 4,121,878 | 10/1978 | Lokken | 312/341 |
| 4,141,525 | 2/1979 | Miller | 248/251 |
| 4,176,890 | 12/1979 | Gorton | 248/251 X |
| 4,289,290 | 9/1981 | Miller | 248/251 |

*Primary Examiner*—Mark Rosenbaum
*Assistant Examiner*—Frances Chin
*Attorney, Agent, or Firm*—Woodard, Emhardt, Naughton Moriarty & McNett

[57] ABSTRACT

A two-piece bracket assembly for use in cabinetry as a drawer slide rear mounting include one piece to receive the rear end of a drawer slide. The other piece is fastened to the inside of the cabinet back. The first piece is pushed into the second piece and retained by spring-clip detent action. Horizontal sliding movement of the clipped portion of the second piece in the first piece is possible when needed for adjustment of the slides to establish parallelism of the drawer front with the cabinet front, without adjustment of the piece fastened to the cabinet back.

12 Claims, 3 Drawing Sheets

METHOD OF ATTACHING AND ADJUSTING A CABINET DRAWER GUIDE ASSEMBLY

This application is a continuation of application Ser. No. 341,700, filed Apr. 17, 1989, which is a division of application Ser. No. 222,508, filed July 21, 1988 both now abandoned.

BACKGROUND OF THE INVENTION

Various drawer guides are used in the cabinetry industry to allow sliding movement of drawers in and out of a cabinet. The drawer guides can be mounted over, under, or on the side of the drawer box. The drawer guides can be made of various materials, i.e. metal, wood or plastic. Drawer guides or slides can allow for partial or full extension of the drawer box from within the cabinet. A drawer slide typically consists of a guiding channel within which rollers mounted on the side of the drawer box are laterally retained, yet the rollers move freely along the channel. The rollers are attached to the case or drawer box using nails, screws or other attachment techniques.

In cabinetry wherein the side, front frame and rear walls are all interconnected forming a box or case, the drawer slide is normally attached to the front and the rear or back of the cabinet. The typical slide mounting procedure is to insert the drawer slide into a mating plastic or metal receptacle, and then attach the receptacle in some manner to the back of the cabinet. If the rear of the drawer slide has been attached to the cabinet back at the factory, a problem can arise thereafter during the installation of the cabinet if uneven or unsquare walls of the installation site pull the cabinet out of square. If the back or rear end of the drawer slide has no lateral movement or adjustment capability, then the drawer front will not properly fit flush against the front of the cabinet when the drawer is moved into the non-square cabinet along the drawer slides. If the rear mounting bracket for the drawer slide has no adjustment, or if the adjustments are made by removing screws or staples prior to relocating the bracket, then adjustments are cumbersome, difficult, and time consuming for the installer. Additionally, where a building foundation has settled and shifted from a relatively square configuration, misalignment of the cabinetry and adjoining drawer slides may also occur If this occurs, adjustment of the drawer slides is necessitated by the circumstances and, typically, the adjustment will require removal of screws or loosening of screws or removal of staples in order to realign the drawer slides. An additional consideration is that wear and tear from heavy and repeated use of the drawer slides may require further adjustment or replacement.

Still a further difficulty with existing bracket assemblies for drawer slides involves the difficulty of installation, wherein the drawer slide attachment and the wall or cabinetry back bracket must be installed simultaneously. A drawer slide rear bracket which consists of two parts, a rear bracket and a slide end bracket installable separately and then matably connected without tools, would simplify installation and improve manufacturing processes by reducing labor costs in the cabinetry industry.

SUMMARY OF THE INVENTION

In a typical embodiment of the present invention a two-piece bracket assembly for use in cabinetry as a drawer slide rear mounting includes one piece to receive the rear end of a drawer slide. The other piece is fastened to the inside of the cabinet back. The first piece is pushed into the second piece and retained by spring-clip detent action. Horizontal sliding movement of the clipped portion of the second piece in the first piece is possible when needed for adjustment of the slides to establish parallelism of the drawer front with the cabinet front, without adjustment of the piece fastened to the cabinet back. The first piece may be a spring metal mounting bracket which has a rear surface adapted for mounting to the inside back wall of the cabinet, and an upper surface and a lower surface projecting from the rear surface toward the front of the cabinet. The upper and lower surfaces are vertically spaced a distance less than the diameter of a cylindrical plug portion of the second piece so the second piece is resiliently gripped tightly in the first, but can be horizontally displaced to the extent needed for the adjustment desired.

A general object of the invention is to provide an improved bracket assembly for use in cabinetry as a drawer slide rear mounting bracket.

Another object is to provide a bracket assembly which allows for lateral adjustment of the drawer slides after installation of the slides and the bracket.

Another object of the invention is to provide for more economical installation of the bracket assembly during the manufacture of cabinetry.

A further object of the invention is to provide a simplified means for realignment of drawer boxes to cabinetry fronts once a cabinet assembly is installed in a room or building having unsquare mounting surfaces.

These and other objects and advantages of the invention will become more apparent upon reference to the following detailed description and accompanying drawings.

DESCRIPTION OF THE PREFERRED EMBODIMENT

Figure 1A:
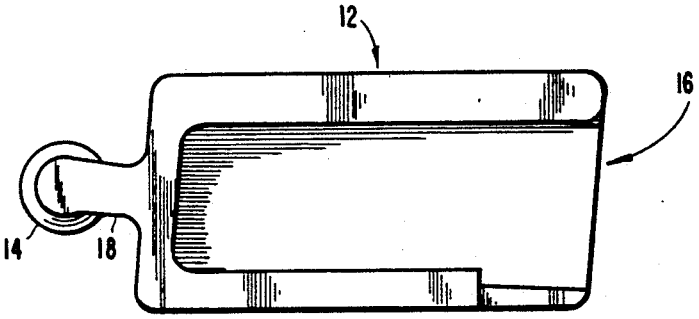
FIG. 1A is a side view of the drawer slide end bracket according to a typical embodiment of this invention.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

A side view of a drawer slide end bracket 12 according to a typical embodiment of this invention is shown in FIG. 1A. The bracket 12 consists of a cylindrical portion 14, a slide end receiving portion 16, and a central portion joining the cylindrical portion and the slide end receiving portion, the central portion being the interconnecting portion 18. The profile height of the interconnecting portion 18, shown in FIG. 1A, is less than the diameter of the cylindrical portion 14. The slide end receiving portion 16 is shown in one form designed to receive particular style and design of drawer slide. It should be noted, however, that the slide end receiving portion 16 can be configured to receive a variety of commercially available drawer slides.

Figure 1C:
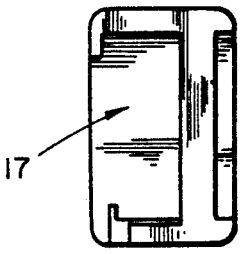
FIG. 1C is a front end view of the drawer slide end bracket shown in FIG. 1A.
Figure 1B:
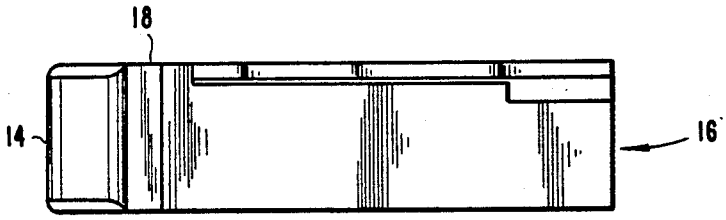
FIG. 1B is a bottom plan view of the drawer slide end bracket shown in FIG. 1A.

Referring now to FIG. 1B. the cylindrical portion 14 is shown attached along its entire length to the interconnecting portion 18. This provides for a maximum amount of support and structural strength between cylindrical portion 14 and drawer end slide receiving portion 16.

Referring to FIG. 1C, a front end view of the slide receiving portion is shown. The channel 17 is sized and shaped to snugly fit a drawer slide as the slide is inserted into the slide end bracket. The slide end bracket is made from nylon, polyethylene, or other similar moldable, lightweight, strong materials.

Figure 2B:
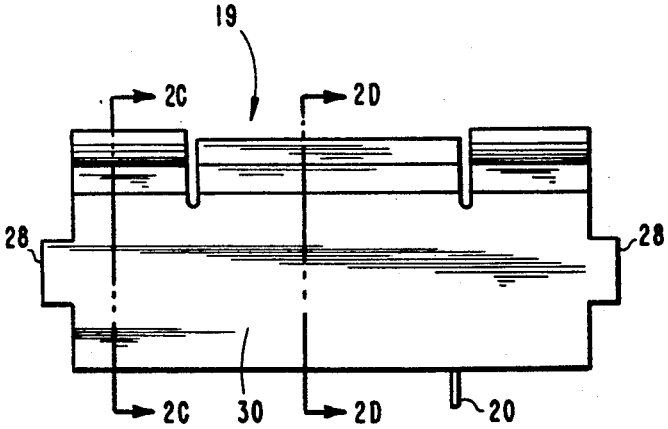
FIG. 2B is a bottom plan view of the mounting bracket shown in FIG. 2A.
Figure 2C:
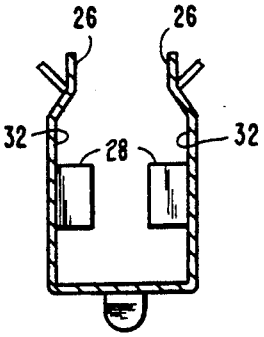
FIG. 2C is a cross sectional view looking in the direction of the arrows 2C—2C in FIG. 2B.
Figure 2A:
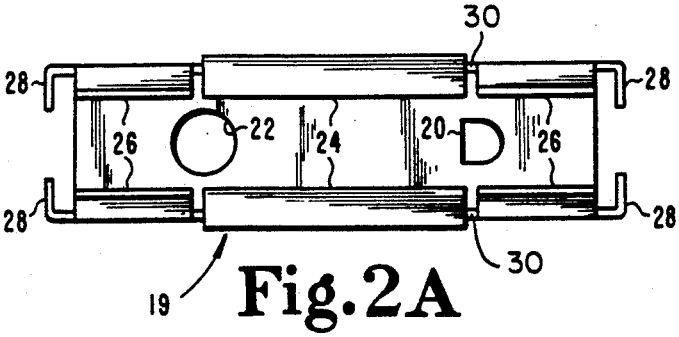
FIG. 2A is a front view of the rear mounting bracket of the typical embodiment of this present invention.

Referring to FIG. 2A. a front view of a mounting bracket 19 is shown. Bracket 19 would normally be made of spring steel of a thickness sufficient enough to support the anticipated weight of the drawer mounted to the drawer slide. The mounting bracket 19 is secured to a rear wall of the cabinetry by inserting tab 20 into a locating hole in the cabinet back and screwing a screw into hole 22 from the inside area of the cabinet or by installing a pop rivet drawn back through the front side of hole 22 and secured from the rear side of the cabinet, at the factory. The cylindrical portion 14 of the slide end bracket 12 is inserted between the detented portions 24 of the mounting bracket. The retaining portions 26 act to retain the cylindrical portion 11 of slide end bracket 12 in FIG. 1A from escaping the channel defined by the upper and lower retaining portions 26. End stops 28 prevent the cylindrical portion 14 of end bracket 12 of FIG. 1A from escaping the lateral ends of the mounting bracket during the adjustment of slide end bracket 12 of FIG. 1A between the end stops of the mounting bracket 19.

FIG. 2B shows a bottom view of mounting bracket 19. End stops 28 are once again visible, and their central location along the edge of the surface 30 further reveals their functionality in retaining the cylindrical portion 14 of slide end bracket 12 once portion 14 is inserted between the surfaces 30 of mounting bracket 19 in FIG. 2A.

FIG. 2C is a sectional view looking in the direction of the arrows 2C—2C in FIG. 2B. The distance between clamping surfaces 32 is dimensionally sized to be slightly smaller than the diameter of the cylindrical portion 14 of slide end bracket 12 in FIG. 1A. The retaining portions 26 are also shown in FIG. 2C.

Figure 2D:
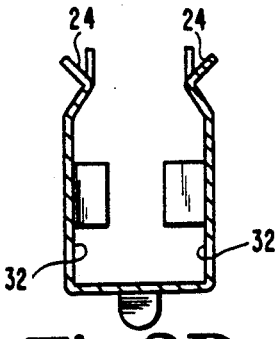
FIG. 2D is a cross sectional view looking in the direction of the arrows 2D—2D in FIG. 2B.

FIG. 2D is a sectional view looking in the direction of the arrows 2D—2D in FIG. 2B. The detented portions 24 taper out for receiving the cylindrical portion 14 of slide end bracket 12 in FIG. 1A. It should also be noted that the detented portions extend along the length of mounting bracket 19 in FIG. 2A for a distance slightly greater than the horizontal width of cylindrical portion 14 of end bracket 12 shown in FIG. 1B.

A typical installation procedure would include inserting the slide end receiving portion 16 of the slide end bracket 12 in FIG. 1A onto a drawer slide. Tab 20 of the mounting bracket 19 would be located in a hole in the rear wall 44 of the cabinet shown in FIG. 3A. Bracket 19 of FIG. 2A would be attached to the rear wall by a screw or pop-rivet inserted into hole 22 of FIG. 2A placed adjacent to the locating tab to assure horizontal mounting of the bracket. Once bracket 19 is mounted to a rear wall, the cylinder portion 14 of drawer slide end bracket 12, with the drawer slide mounted to it, is then inserted between the detenting portions 24 of mounting bracket 19 in FIG. 2A. Then the front end of the drawer slide is mounted to the cabinet frame at the front. Alignment of the drawer slide is then accomplished by manually moving the rear end of the slide back and forth between end stops 28 of FIG. 2A until the slide is in the relative position desired for alignment of the drawer front with the cabinetry front.

Figure 3A:
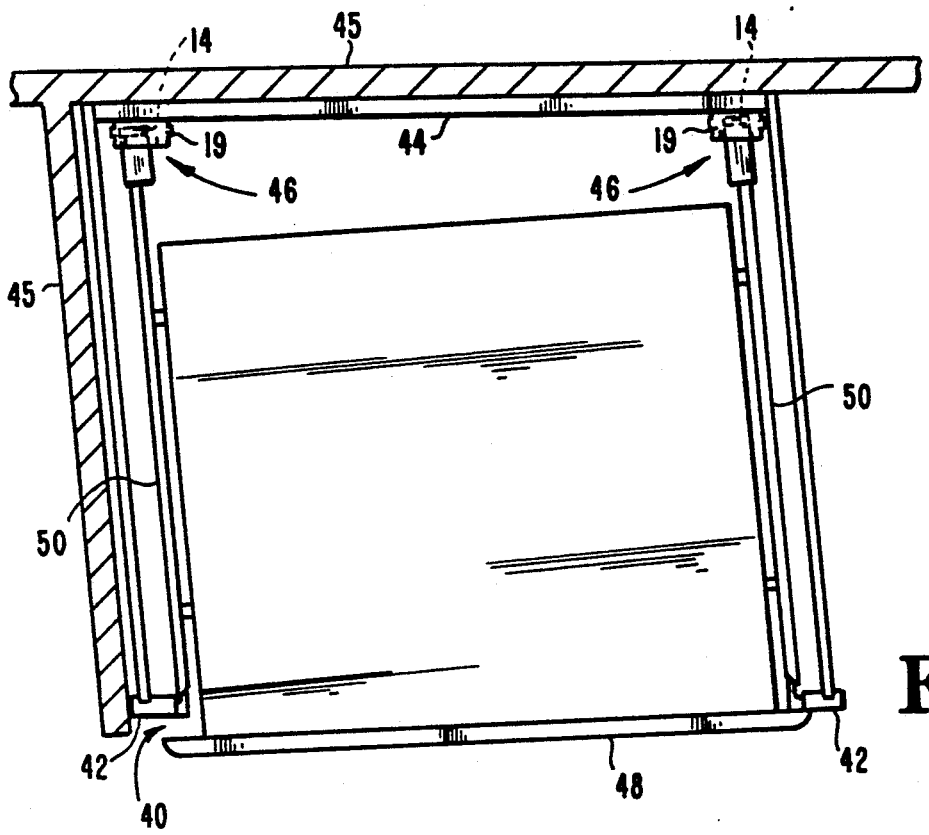
FIG. 3A is a top view of a cabinet frame assembly showing a drawer box mounted to drawer slides and the cabinetry having a non-square installation site with the drawer slides unadjusted.
Figure 3B:
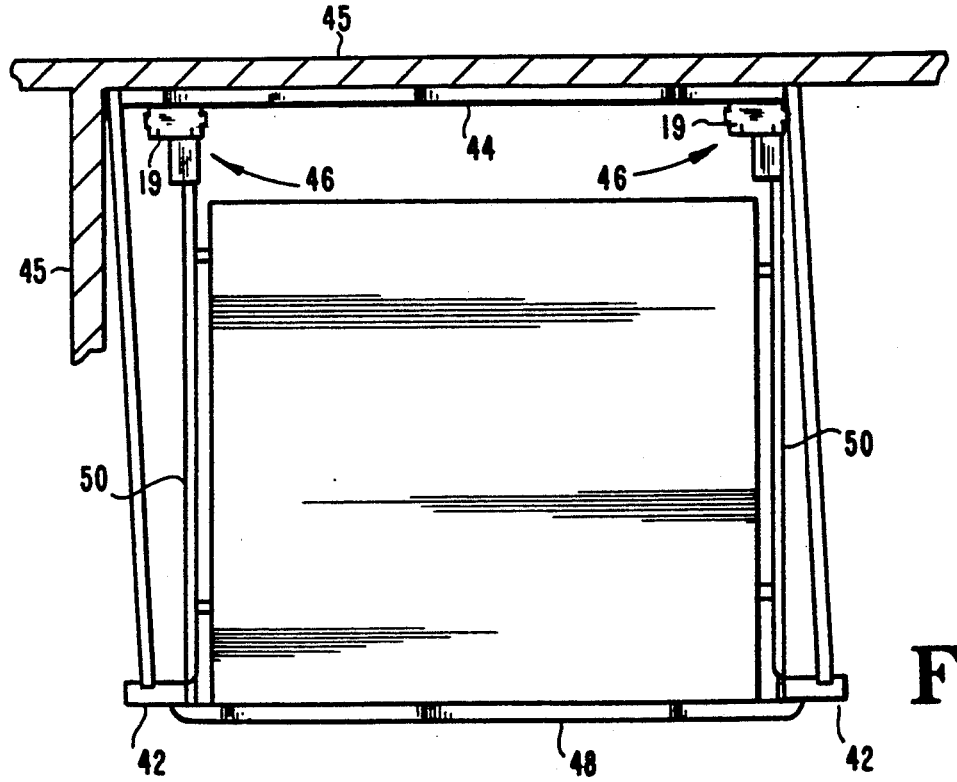
FIG. 3B is a top view of a cabinetry assembly in an unsquare installation site and showing a drawer box, a front and rear wall, and the present invention connected to the drawer slides facilitating the proper alignment of the drawer box.

FIG. 3A depicts the top view of a cabinetry frame installed in an out-of-square building corner 45, for example. The condition is shown exaggerated for ease of illustration. A gap 40 is produced between the cabinet front and the drawer front 48 due to the unsquare relation of the cabinet back 44 with the cabinet front wall 42, resulting from the constraints of the installation site. Adjusting the bracket assemblies 46, by sliding the cylindrical portions 14 to the right in the spring clip brackets 19, will cause the gap 40 to be eliminated by establishing parallelism of the drawer front flange 48 and the cabinet front wall 42. FIG. 3B shows the results of the adjustment of bracket assemblies 46 wherein the drawer front flange 48 and the cabinet front wall 42 are perfectly aligned and no gap exists along the drawer front flange 48 and the cabinetry front wall 42. Drawer slides 50 are moved either individually, or together with the drawer front flange 48 positioned between the slides to move the slides simultaneously to perfect an alignment suitable to overcome the non-squareness of the cabinet frame due to the installation site.

Figure 4B:
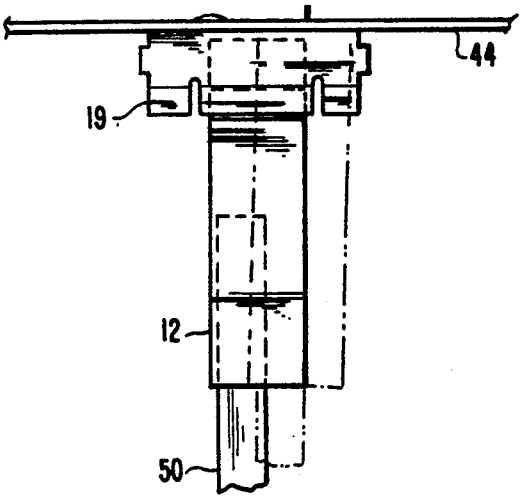
FIG. 4B is a top view of the bracket assembly shown in FIG. 4A illustrating one possible adjustment of the bracket to counteract an unsquare mounting.
Figure 4A:
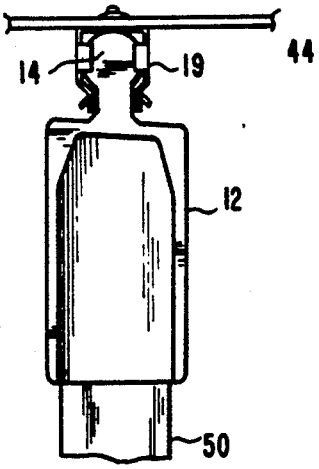
FIG. 4A is side view of the slide bracket assembly according to one embodiment of the present invention.

Referring to FIG. 4A, depicting the bracket assembly rotated 90 degrees from a normal viewing angle for engineering drawing relationship with FIG. 4B, the slide 50 is shown inserted into the slide end bracket 12, and the end bracket cylindrical portion 14 is shown inserted into the mounting bracket 19. The mounting bracket 19 is shown mounted to cabinet back 44. FIG. 4B illustrates in the dashed lines, a lateral adjustment of the end bracket 12 within the mounting bracket 19 as in FIG. 3B, accomplished without the aid of special tools or requiring removal of the bracket assembly and remounting.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. A method for attaching a rear end of a first drawer slide to a mounting surface whereby lateral movement of the rear end of the slide is facilitated, said method comprising the following steps:

a. providing said drawer slide with an end bracket fixed at said rear end;

b. attaching a mounting bracket to the mounting surface, said mounting bracket having a front with means for receiving said end bracket;

c. inserting the end bracket into the receiving means on the front of the mounting bracket;

d. manually moving the first slide laterally at said rear end to align the slide so that a drawer supported by said first slide will move along a desired line of motion, said line of motion being parallel with another slide attached to and supporting the drawer; and e. resiliently gripping the end bracket in the receiving means on the front of the mounting bracket to stabilize the rear end of the first slide against lateral movement during opening and closing of the drawer after the manually moving step.

2. The method of claim 1 wherein the mounting bracket is attached to the mounting surface by inserting a tab extending from a rearward surface of the mounting bracket into a hole in the mounting surface and attaching the mounting bracket to the mounting surface by affixing to the mounting surface a fastener extending through a second hole in the mounting surface and a hole in the mounting bracket, said attaching operation performed from the opposite side of the mounting surface to which the mounting bracket is attached.

3. The method of claim 1 and wherein:

said providing step includes providing said end bracket with a slide end receiving portion, and pushing the rear end of said slide into said slide end receiving portion.

4. The method of claim 1 and wherein:

said attaching step includes attaching a mounting bracket which is also adapted to allow vertical movement of the front end of the first slide after said mounting a drawer slide, attaching, and mounting the slide end bracket steps.

5. A method of mounting a drawer in an opening in a front wall of a cabinet having front and rear walls and comprising the steps of:

supporting a front end of a drawer slide at a rear side of said front cabinet wall;

fastening a clip to said rear wall generally behind said front end;

providing the drawer slide having a rear end mount adaptor at a rear end;

clipping said slide rear end mount adaptor into said clip;

mounting a drawer on said slide, said drawer having a planar front flange;

laterally moving said clipped rear end mount adaptor until an inner face of said drawer flange is parallel to the front wall of said cabinet; and resiliently gripping said clipped rear end mount adaptor to stabilize said rear end of said slide against lateral movement during opening and closing of the drawer.

6. The method of claim 5 and further comprising the steps of:

supporting the front end of a second drawer slide at the rear side of said front cabinet wall;

fastening a second clip to said rear wall generally behind the front end of said second drawer slide;

pushing a front end of a second slide rear end mount adaptor onto the rear end of said second drawer slide;

clipping a rear end of said second slide rear end mount adaptor into said second fastening clip;

mounting said second slide on said drawer; and laterally moving said clipped end of said second drawer slide rear end mount adaptor until the innerface of said drawer flange is parallel to the front wall of said cabinet.

7. The method of claim 6 and wherein:

the front ends of the drawer slides are supported by mounting the front ends of said slides at adjacent sides of said opening in said front wall.

8. The method of claim 5 and wherein:

said providing step includes providing said rear end mount adaptor with a slide end receiving portion, and inserting the rear end of said slide into said receiving portion.

9. A drawer mounting method comprising the steps of:

providing a first drawer slide with an end bracket at a rear end;

attaching a back side of a mounting bracket to a first stationary mounting surface in a cabinet, the mounting bracket also having a front with a receptacle for receiving said end bracket;

mounting the end bracket to the mounting bracket by inserting the end bracket into the receptacle on the front of the mounting bracket;

supporting a front end of said drawer slide on a second stationary mounting surface which is spaced from and in front of said first mounting surface in the cabinet;

manually moving the first slide laterally at said rear end while holding said front end stationary to align the first slide so that a drawer supported by said first slide will move along a desired line of motion in the cabinet; and resiliently gripping the end bracket in the receptacle to stabilize the rear end of said first slide against lateral movement during opening and closing of the drawer after said manually moving step.

10. The method of claim 9 wherein the mounting step comprises:

clipping the end bracket to the mounting bracket.

11. The method of claim 10 wherein:

said first stationary mounting surface is a front surface of a rear wall of the cabinet, and said second stationary mounting surface is at a front wall of the cabinet, and said front wall has a planar front surface with an opening therein to receive a drawer therethrough, the method further comprising the steps of:

mounting on the slide, a drawer having a planar front flange;

moving the drawer through said opening until the flange meets the planar front surface;

performing the slide rear end moving step until said planar surface of said flange is substantially parallel to said planar front surface of said front wall.

12. The method of claim 9 and wherein:

said providing step includes providing said end bracket with a slide end receiving portion, and inserting the rear end of said slide into said receiving portion.

* * * * *